United States Patent [19]

Davis et al.

[11] Patent Number: 4,954,017

[45] **Date of Patent: * Sep. 4, 1990**

[54] EXPANSION BOLT AND MINE ROOF REINFORCEMENT

[75] Inventors: Robert L. Davis; Harold D. Keith, both of Rolla, Mo.

[73] Assignee: The Curators of the University of Missouri, Columbia, Mo.

[ * ] Notice: The portion of the term of this patent subsequent to Jan. 13, 2004 has been disclaimed.

[21] Appl. No.: 906,269

[22] Filed: Sep. 10, 1986

Related U.S. Application Data

[63] Continuation of Ser. No. 205,601, Nov. 10, 1980, Pat. No. 4,636,115.

[51] Int. Cl.[5] ..... E21D 21/00

[52] U.S. Cl. ..... 405/259; 405/288; 411/19

[58] Field of Search ..... 405/259, 260, 261, 288; 411/15, 19, 20, 44, 61

[56] References Cited

U.S. PATENT DOCUMENTS

| | | | |
|---|---|---|---|
| 1,802,270 | 4/1931 | Rawlings | 411/61 |
| 2,667,037 | 1/1954 | Thomas et al. | 411/15 X |
| 3,568,450 | 3/1971 | Whiting | 411/19 X |
| 3,665,719 | 5/1972 | Whiting | 405/289 |
| 3,837,258 | 9/1974 | Williams | 411/44 |
| 3,922,867 | 12/1975 | Scott | 405/259 X |
| 3,940,941 | 3/1976 | Libert et al. | 405/261 |
| 4,012,913 | 3/1977 | Scott | 405/259 X |
| 4,459,067 | 7/1984 | Skogberg et al. | 405/259 |

FOREIGN PATENT DOCUMENTS

| | | | |
|---|---|---|---|
| 0000576 | 7/1978 | European Pat. Off. . | |
| 80850025 | 3/1980 | European Pat. Off. . | |
| 2199090 | 9/1973 | France . | |
| 2316528 | 7/1976 | France . | |
| 1448753 | 9/1976 | United Kingdom | 411/19 |
| 2072784 | 9/1981 | United Kingdom | 411/19 |

*Primary Examiner*—David H. Corbin

*Attorney, Agent, or Firm*—Senniger, Powers, Leavitt and Roedel

[57] ABSTRACT

An expansion bolt, adapted to be anchored in a hole, having a hollow shank portion adapted to hold a pressurizing fluid and to expand girthwise on pressurization of the fluid, and further having a threaded portion adapted on insertion of the shank portion in the hole to extend out of the hole and to have a nut threaded thereon, whereby, following insertion of the shank portion of the bolt, in an unexpanded condition, in the hole, the shank portion may be expanded by pressurization of fluid therein for anchoring it in the hole and the nut threaded up on the threaded portion of the bolt.

32 Claims, 1 Drawing Sheet

EXPANSION BOLT AND MINE ROOF REINFORCEMENT

This is a continuation of application Ser. No. 205,601, filed Nov. 10, 1980, now U.S. Pat. No. 4,636,115.

BACKGROUND OF THE INVENTION

This invention relates to an expansion bolt, and more particularly to an expansion roof bolt adapted to hold a pressurizing fluid therein and to expand girthwise upon pressurization of the fluid for anchorage of the bolt in a bore in the roof of a mine for supporting the roof and the method of using it to reinforce the roof.

Various types of anchoring means have been used for supporting the roof of a mine. A widely used anchoring means is the "point-anchored" expansion bolt system comprising a bolt having a head and a threaded shank, and an expansible shell unit on the shank at its end away from the head comprising a shell having a plurality of leaves and a tapered plug threaded on the shank. To anchor the bolt in a bore in the roof of a mine, the bolt with the expansible shell unit thereon is inserted in the bore and the bolt is turned, thereby moving the tapered plug down along the shank into engagement with the leaves of the shell held on the shank against movement therealong for forcing the leaves to move outwardly into engagement with the roof strata. Continued turning of the bolt moves the head up into pressurized engagement with the roof, and tensions the shank for clamping the roof strata together. Among the disadvantages of this system is that it is not effective in relatively soft roof strata, such as that found in uranium mines, and that, over time, the expansible shell unit creeps down in the bore with a resultant decrease in the clamping force applied to the roof strata by the bolt.

Another widely used anchoring means is the so-called "grouted" roof bolt system, such as shown, for example, in U.S. Pat. No. 3,940,941, involving two-component charges of epoxy resin and a bolt having a nut threaded on an end thereof. To install the bolt in a bore in the roof of a mine, charges of unmixed resin are inserted in the bore, the bolt is partially inserted in the bore and rotated to mix the components of the resin, and the bolt is fully inserted in the bore with the nut held in engagement with the roof until the resin sets. On hardening of the resin, the bolt is bonded in place, and pegs the roof strata together. However, "grouted" bolts are more difficult and more expensive to install than "pointanchored" expansion bolts, and provide insufficient load carrying capacity in roof strata having significant fractures and voids in that the resin extrudes into these openings with a resultant decrease in the strength of the bond between the bolt and the roof. Moreover, there is no inspection technique, in general use, to evaluate the integrity of the bond.

Yet another and more recently developed anchoring means is the "friction rock stabilizer" system, such as shown, for example, in U.S. Pat. Nos. 3,922,867 and 4,012,913, involving a hollow cylindrical body of steel open at its ends and split along a line parallel to its longitudinal axis to enable the body to contract girthwise upon being compressed for enabling its insertion in a bore in the roof of a mine of smaller diameter than the diameter of the tube when uncompressed. As the tube is inserted, the compressive force is released and the tube expands girthwise into pressurized frictional engagement with the surfaces of the roof defining the bore.

While the body is effective in stabilizing relatively soft roof strata and in retaining its load carrying capacity upon shifting of the mine roof, its load carrying capacity is relatively limited, being essentially equal to the upward force applied to the lower end of the body to insert it in the bore.

SUMMARY OF THE INVENTION

Among the several objects of this invention may be noted the provision of an expansion bolt and method of use for anchorage in a hole such as a bore in the roof of a mine; the provision of such a bolt which is adapted to hold a pressurizing fluid and to be expanded girthwise upon pressurization of the fluid; the provision of such a bolt which clamps or compresses the roof strata together; the provision of such a bolt which pegs the roof strata together for substantially the entire portion of the length of the bolt in the bore; the provision of such a bolt which is expanded after being fully inserted in the bore; the provision of such a bolt which is effective in stabilizing relatively soft roof strata; the provision of such a bolt which has increased load carrying capacity for supporting the roof; the provision of such a bolt which applies lateral compressive force to the mine roof counteracting, at least in part, the lateral tension force present in a mine roof due to its tendency to sag; the provision of such a bolt which deforms, upon shifting of the mine roof, to retain its load carrying capacity; the provision of such a bolt having a pressure relief feature to prevent "overloading" of the bolt; the provision of such a bolt which may be readily inspected, after its installation, to establish that it remains in pressurized engagement with the surfaces of the mine defining the bore and thus is capable of supporting the roof; the provision of such a bolt which may be expanded further after its installation to increase its load carrying capacity; and the provision of such a bolt which is simple and economical to manufacture and install.

In general, an expansion bolt of this invention is adapted for insertion in an initial unexpanded condition in a hole drilled in a body (e.g., a mine roof) in which the bolt is to be anchored, and adapted to be expanded girthwise after being inserted in the hole to anchor it in the hole. It has an elongate hollow shank portion constituted by a relatively thin-walled tubular metal member closed at one end constituting its inner end as inserted in the hole and having a head at its other end constituting its outer end. The head is exteriorly threaded for reception of a nut and extends out of the hole when the bolt is anchored in the hole. The tubular member, in its unexpanded condition, is of fluted cross section, and is adapted to hold a fluid under pressure and to expand girthwise under pressure of fluid therein. The head is constructed for delivery of fluid under pressure into the tubular member whereby, following insertion of the tubular member in a hole, fluid under pressure may be delivered into the tubular member to cause it to expand girthwise into pressure engagement with the body within the hole for anchoring it in the hole.

Other objects and features of this invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
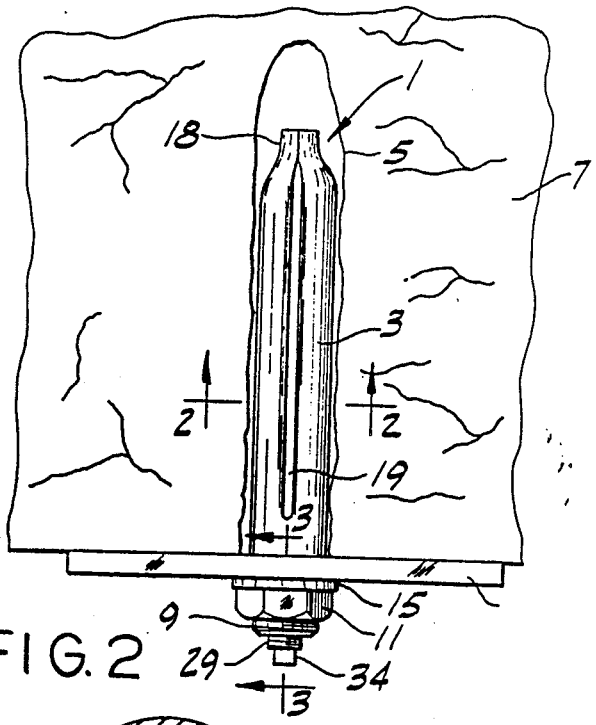
FIG. 1 is a section through a bore in the roof of a mine showing an expansion bolt of this invention therein, prior to the girthwise expansion of the bolt.
Figure 3:
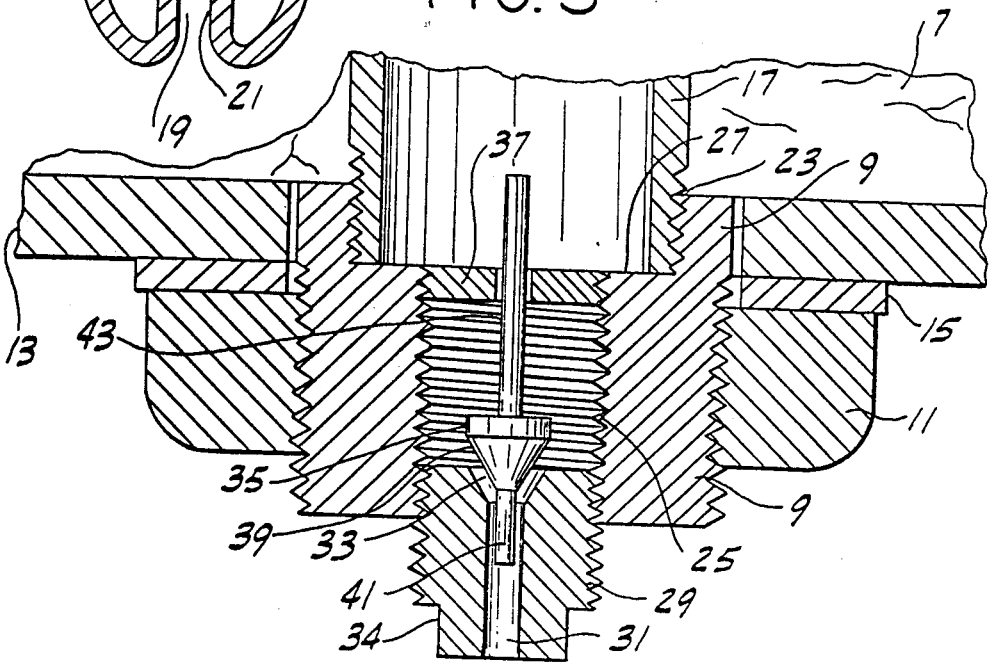
FIG. 3 is an enlarged longitudinal section of the lower end of the bolt on line 3—3 of FIG. 1.

Referring to FIG. 1 of the drawings, there is generally indicated at 1 an expansion bolt of this invention comprising a hollow shank portion 3 shown extending up in a drill hole or bore 5 in the roof 7 of a mine, and a threaded portion constituting a head 9 shown extending down out of the bore and having a nut 11 threaded thereon. As best illustrated in FIG. 3, a roof bolt plate 13 and a washer 15 are carried on the head, the washer 15 bearing on the upper or inner face of the nut, the roof bolt plate 13 bearing on the upper or inner face of the washer. With the hollow shank portion 3 anchored in the bore 5, in a manner described hereinafter, the nut 11 may be turned to bring the roof bolt plate 13 into pressurized engagement with the mine roof 7 for supporting the roof.

Figure 2:
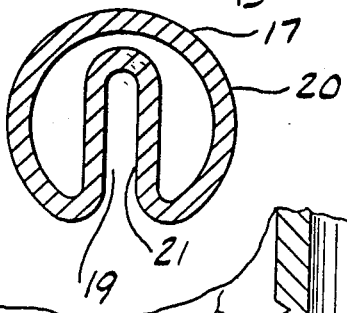
FIG. 2 is a transverse section of the bolt on line 2—2 of FIG. 1.

In particular, the hollow shank portion 3 of the bolt comprises a relatively thin-walled tubular metal member 17, more particularly a a thin-walled tube 17 of suitable deformable material such as a low-carbon steel (e.g., 1016 carbon steel) of a suitable thickness (e.g., one-eighth inch), and of a suitable length (e.g., 3–5 feet long). The tube is crimped and welded closed at one end 18 (i.e., its upper or inner end), as shown in FIG. 1, and is threaded at its other (lower) its or outer end, as shown in FIG. 3, the head 9 being threaded onto the lower end of the tube and closing the tube thereby enabling the bolt to hold pressurizing fluid such as water therein. Upon pressurization of the fluid, the tube 17 is adapted to expand girthwise. To facilitate this expansion, the tube 17 which of a suitable outer diameter (e.g., $1\frac{3}{8}$–$1\frac{3}{4}$ inch), in its unexpanded condition, is so formed as to be of fluted cross section with a generally circular overall outline. More particularly, the tube has a recess 19 in its outer periphery extending from the closed upper end 18 of the tube down toward but stopping short of the lower end of the tube. When viewed in transverse section, as shown in FIG. 2, the tube is of closed cross section, forming a first portion 20 which is its major portion, in the shape of an arc of a circle and a second generally U-shaped portion 21 bent inwardly to a position within the confines of the circle. Portion 20, being in the shape of an arc of a circle, has a generally cylindrical outer surface.

The head 9 is generally cylindrical, having a circular recess 23 in its upper end and a circular passage 25 of smaller diameter than the recess extending down through the head from the recess to the lower end of the head, a shoulder 27 thereby being formed in the head between the recess 23 and the passage 25. The recess 23 and the passage 25 are internally threaded, the recess receiving the lower end margin of the tube 17 in threaded engagement, with the lower end of the tube engaging the shoulder 27, the passage receiving a threaded plug 29 in threaded engagement.

The plug 29 has an axial hole 31 therein opening into a conical recess in the upper surface thereof constituting a valve seat 33. A threaded adapter of a line (not shown) to a source of fluid under pressure (not shown) is adapted to be threaded on the plug for enabling flow of fluid into the tube 17 via the hole 31 in the plug and the passage 25 in the head. The plug further has a projection 34 of generally square section at its lower end enabling the plug to be turned by a wrench or other suitable tool to advance the plug up in the passage 25 in the head. With fluid held in the bolt, the plug 29, on being advanced up in the passage 25, displaces fluid from the passage up into the tube 17, the plug and the passage thus constituting an expansible chamber means for pressurizing the fluid held in the tube.

A valve member 35 is provided in the passage 25 for holding fluid in the bolt and means, such as a disc 37, is secured in the passage for retaining the valve member in the passage. The valve member 35 has a conical central portion 39 engageable with the valve seat 33 in the plug, a lower projection or stem 41 extending down in the hole 31 in the plug, and an upper projection or stem 43 extending up in the hole in the disc 37, the projections or stems holding the valve member in alignment with the valve seat. The valve member 35 functions as a check valve being movable away from the valve seat 33 in the plug 29 for flow of fluid into the tube 17 and moving into engagement with the valve seat 33 to block fluid flow out of the tube. In addition, the valve member 35 is constructed of a suitable elastomeric material such as natural or synthetic rubber or a low yield strength material such as aluminum, and thus also functions as a relief valve for the bolt in being adapted to be extruded out of the hole 31 in the plug when fluid pressure above a predetermined level is developed in the bolt, such as may occur on shifting of the mine roof and resultant compressive deformation of the tube.

Figure 4:
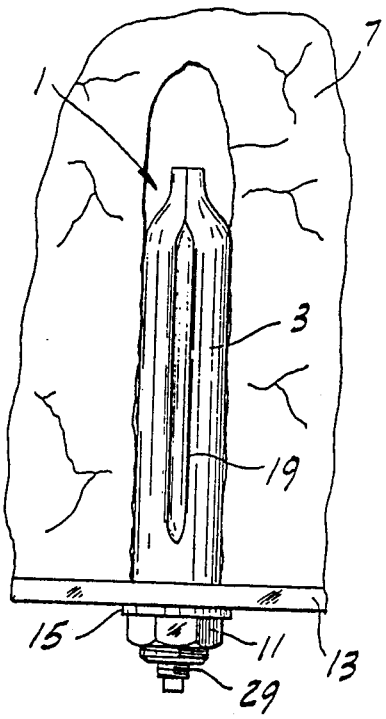
FIG. 4 is a view similar to FIG. 1 showing the bolt expanded girthwise into pressurized engagement with the surfaces of the mine roof defining the bore.

To anchor a bolt 1 of this invention in a bore 5 in the roof 7 of a mine, the bolt, in its unexpanded condition, is inserted into the bore, with the head 9 thereof extending down out of the bore, as shown in FIG. 1. A threaded adapter (not shown) of the line to a source of fluid under pressure (not shown) is threaded on the plug 29, and fluid at a predetermined pressure is introduced into the bolt to expand the tube girthwise into pressurized engagement of its generally cylindrical outer surface with the surfaces of the roof defining the bore for anchoring the bolt in the bore as shown in FIG. 4. The roof bolt plate 13 and washer 15 are positioned on the head, and the nut 11 is threaded up on the head to bring the roof bolt plate 13 into pressurized engagement with the roof 7 for supporting it, the load carrying capacity of the bolt for supporting the roof being a function of the magnitude of the static frictional force between the bolt and the surfaces of the mine defining the bore 5 and thus of the pressure of the fluid in the bolt.

Shifting of the mine roof 7 may affect the load carrying capacity of the bolt. Being deformable, the bolt accomodates most shifts of the mine roof and retains its as-installed load carrying capacity. However, to ensure that the bolt is properly anchored, the bolt may be inspected (monitored) from time to time by measuring the pressure of the fluid. The check valve member 35 is readily opened from outside the head 9 for this purpose. If the fluid pressure is found to be below a predetermined level, the pressure may be increased by reconnecting the line to the source of fluid under pressure (not shown) to the plug 29, or by turning the plug 29 to advance it up in the passage 25. In the event that the shifting of the mine roof causes compressive deformation of the bolt of sufficient magnitude as to increase the fluid pressure above a predetermined relief pressure, the valve member 35 is extruded through the hole 31 in the plug 29 to release the fluid in the bolt.

In certain respects, the expansion bolt of this invention, when anchored, supports the roof in a manner similar to each of the prior art types of anchoring means. Like the "point anchored" mechanical bolt, the bolt of this invention, upon tightening of the nut 11 thereon, effects a clamping of the roof strata. Like the "grouted" bolt system, the bolt of this invention pegs the roof strata together. And like the "friction rock stabilizer" system, the bolt of this invention is effective in relatively soft roof strata, and retains its load carrying capacity on most shifts of the mine roof. However, the bolt of this invention in contrast to the prior art anchoring means has increased load carrying capacity, may be inspected to ensure proper anchorage, and applies a lateral compressive force to the mine roof counteracting, at least in part, the lateral tension force present in the roof due to the tendency of the mine roof to sag.

While the bolt 1 of this invention has been described above and shown in the drawings as being anchored in a bore 5 in the roof of a mine, it is contemplated it could be anchored in a hole in other structures such as the floor or wall of a building. Moreover, while the upper end 18 of the tube 17 is described and shown as being closed by crimping and welding and the head 9 threaded on the lower end of the tube, it is contemplated that the upper end of the tube could be closed by an end cap (not shown) welded or threaded to the upper end of the tube, and the head 9 welded onto the lower end of the tube.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An expansion bolt adapted for insertion in an initial unexpanded condition in a circular hole drilled in a body in which the bolt is to be anchored, and adapted to be expanded girthwise after being inserted in the hole to anchor it in the hole, said bolt having an elongate hollow shank portion constituted by a relatively thin-walled tubular metal member closed at one end constituting its inner end as inserted in the hole and having a head at its other end constituting its outer end, said head being exteriorly threaded for reception of a nut and extending out of the hole when the bolt is anchored in the hole, said tubular member being adapted to receive a fluid under pressure, said tubular member being of closed cross section and of generally circular overall outline smaller than the circular hole for insertion of the bolt therein and being of fluted formation with a portion within said outline such as to enable girthwise expansion thereof under pressure of fluid therein for pressure engagement of a major portion thereof having a generally cylindrical outer surface with the body within the hole, and said head being constructed for delivery of fluid under pressure into said tubular member whereby, following insertion of the tubular member in a hole, fluid under pressure may be delivered into the tubular member to cause it to expand girthwise into pressure engagement of said generally cylindrical outer surface with the body within the hole for anchoring it in the hole.

2. An expansion bolt as set forth in claim 1 wherein the head has a passage for flow of pressurizing fluid into the tubular member.

3. An expansion bolt as set forth in claim 2 further comprising means associated with the head for pressurizing the fluid held in the tubular member.

4. An expansion bolt as set forth in claim 3 wherein the pressurizing means comprises expansible chamber means in the head.

5. The expansion bolt as set forth in claim 4 wherein the expansible chamber means comprises a plug in threaded engagement with the head in the passage, whereby, on turning the plug to advance it in the passage, pressurizing fluid may be displaced from the passage into the tubular member.

6. An expansion bolt as set forth in claim 1 wherein the tubular member has an unexpanded crosssectional shape comprising a first portion generally in the shape of an arc of a circle providing said major portion and a second portion bent inwardly to a position within the confines of the circle.

7. An expansion bolt as set forth in claim 6 wherein said second portion is of U-shape.

8. An expansion bolt as set forth in claim 7 wherein the head comprises a cylindrical member having an axial passage therethrough from one end constituting its outer end to its other end constituting its inner end, said cylindrical member having a recess at its inner end surrounding the inner end of the passage, the outer end of the tubular member being secured in said recess, and means at the outer end of the passage for connection of a line for delivery of fluid under pressure to and through the passage.

9. An expansion bolt adapted for insertion in an initial unexpanded condition in a circular hole drilled in a body in which the bolt is to be anchored, and adapted to be expanded girthwise after being inserted in the hole to anchor it in the hole, said bolt having an elongate hollow shank portion constituted by a relatively thin-walled tubular metal member closed at one end constituting its inner end as inserted in the hole and having a head at its other end constituting its outer end, said tubular member being adapted to receive a fluid under pressure, said tubular member being of closed cross section and of generally circular overall outline smaller than the circular hole for insertion of the bolt therein and being of fluted formation with a portion within said outline, a major portion thereof having a generally cylindrical outer surface, said tubular formation being such as to enable girthwise expansion thereof under pressure of fluid therein, said head having a passage therethrough to said tubular member and valve means in said passage in the head adapted to open for delivery of fluid under pressure through said passage into said tubular member for expanding it girthwise into pressure engagement of said generally cylindrical outer surface with the body within the hole after the bolt has been inserted in a hole and to close for maintaining fluid under pressure in said expanded tubular member for anchoring it in the hole.

10. An expansion bolt as set forth in claim 9 wherein the valve means is adapted to be opened from outside the head for monitoring pressure in the expanded tubular member from time to time.

11. An expansion bolt as set forth in claim 9 wherein the tubular member has an unexpanded cross-sectional shape comprising a first portion generally in the shape of an arc of a circle providing said major portion and a second portion bent inwardly to a position within the confines of the circle.

12. An expansion bolt as set forth in claim 11 wherein said second portion is of U-shape.

13. An expansion bolt as set forth in claim 11 wherein the valve means is adapted to be opened from outside the head for monitoring pressure in the expanded tubular member from time to time.

14. The method of reinforcing the roof of a mine comprising: providing an expansion bolt having an elongate hollow shank portion constituted by a relatively thin-walled tubular metal member closed at one end constituting its inner end and having a head at its other end constituting its outer end, said tubular member being adapted to hold a fluid under pressure, said tubular member being of closed cross section and of generally circular overall outline smaller than the circular hole for insertion of the bolt therein and being of fluted formation with a portion within said outline, a major portion thereof having a generally cylindrical outer surface, said tubular formation being such as to enable girthwise expansion thereof under pressure of fluid therein, said head having valve means therein adapted to open for delivery of fluid under pressure into said tubular member for expanding it girthwise into pressure engagement of said generally cylindrical surface with the body within the hole and to close for maintaining pressure in said tubular member, providing a circular hole in the roof of such size as to permit insertion of the shank portion of the bolt therein with the head extending down out of the hole, connecting a source of fluid under pressure to the passage in the head and delivering fluid under pressure through the passage, the valve being open, into the tubular member for expanding it girthwise into pressure engagement of said generally cylindrical outer surface with the roof within the hole for anchoring it in the hole, and effecting closing of the valve means to maintain pressure in the expanded tubular member.

15. The method of claim 14 further comprising monitoring the pressure in the expanded tubular member from time to time.

16. The method of claim 15 wherein the pressure is monitored by opening the valve means.

17. The method of reinforcing the roof of a mine comprising:

providing an expansion bolt having an elongate hollow shank portion constituted by a relatively thin-walled tubular metal member closed at one end constituting its inner end and having a head at its other end constituting its outer end, said tubular member, in its unexpanded condition, having a closed cross-sectional shape comprising a first and major portion generally in the shape of an arc of a circle having a generally cylindrical outer surface and a second portion bent inwardly to a position within the confines of the circle, said tubular member being adapted to expand girthwise under pressure of fluid therein, said head having a passage for delivery of fluid under pressure to said tubular member for expanding it, providing a circular hole in the roof of such size as to permit insertion of the shank portion of the bolt therein with the head extending down out of the hole, and connecting a source of fluid under pressure to the passage in the head and delivering fluid under pressure through the passage into the tubular member for expanding it girthwise into pressure engagement of said generally cylindrical outer surface with the roof within the hole for anchoring it in the hole.

18. An expansion bolt adapted for insertion in an initial unexpanded condition in a circular hole drilled in a body in which the bolt is to be anchored, and adapted to be expanded girthwise by fluid under pressure after being inserted in the hole to anchor it in the hole, said bolt having an elongate hollow shank portion constituted by a relatively thin-walled tubular metal member closed at one end constituting its inner end as inserted in the hole and having means at its other end constituting its outer end with a passage therethrough to the interior of said shank portion for delivery of fluid under pressure into said shank portion for expanding it girthwise, said tubular metal member in its initial unexpanded condition having a closed cross-sectional shape a major portion of which is of continuous generally circular form having a generally cylindrical outer surface and another portion of which, continuous with said major portion, is bent into the form of a loop extending inwardly with respect to said major portion, said loop permitting girthwise expansion of said tubular metal member into pressure engagement of said generally cylindrical outer surface with the surface of the body within the hole on delivery of fluid under pressure through said passage into said tubular metal member.

19. An expansion bolt as set forth in claim 18 wherein said means at said outer end of said tubular metal member comprises a head having said passage therein and being exteriorly threaded for reception of a nut and extending out of said hole when the bolt is anchored in the hole.

20. An expansion bolt as set forth in claim 19 having valve means in the passage in the head adapted to open for delivery of fluid under pressure through said passage into the tubular metal member for expanding it girthwise after the bolt has been inserted in a hole and to close for maintaining fluid under pressure in said expanded tubular member for anchoring it in the hole.

21. The method of reinforcing the roof of a mine comprising:

providing an expansion bolt having an elongate hollow shank portion constituted by a relatively thin-walled tubular metal member closed at one end constituting its inner end and having means at its other end constituting its outer end with a passage therethrough to the interior of said shank portion for delivery of fluid under pressure into said shank portion for expanding it girthwise, said tubular metal member in its initial unexpanded condition having a closed cross-sectional shape a major portion of which is of continuous generally circular form having a generally cylindrical outer surface and another portion of which, continuous with said major portion, is bent into the form of a loop extending inwardly with respect to said major portion, said loop permitting girthwise expansion of said tubular metal member into pressure engagement of said generally cylindrical outer surface with the surface of the body within the hole on delivery of fluid under pressure through said passage into said tubular metal member;

providing a circular hole in the roof of such size as to permit insertion of the shank portion of the bolt therein inner end first with said passage means at the lower end of the hole, and connecting a source of fluid under pressure to said passage and delivering fluid under pressure through the passage into the tubular member for expanding it girthwise into pressure engagement of said generally cylindrical outer surface with the roof within the hole for anchoring it in the hole.

22. In a method of rock bolting wherein an elongated tube-formed bolt is first inserted into a circular borehole and then expanded against the borehole, the improvement comprising:

inserting a bolt freely into the borehole which, before being expanded, in its tubular cross-section has a peripheral length in a direction transverse to the axial direction of the bolt that exceeds the circumference of the borehole, the bolt having a closed cross-section with a major portion thereof having a generally cylindrical outer surface and with at least a part of its closed cross-section initially inwardly collapsed toward the axis of the bolt continuously along a substantial length of the bolt so that in its initially collapsed state the bolt is slimmer than the borehole and so that it can be freely inserted into the borehole; then expanding said bolt by applying an expansion medium internally of the bolt such that said generally cylindrical outer surface is moved into contact with the borehole to frictionally clamp against the walls of the borehole.

23. Method according to claim 22 wherein said bolt is closed at its bottom end; and said expanding step comprises pressurizing said bolt to expand same.

24. Method according to claim 23, wherein said pressurizing step comprises connecting said bolt to an external source of pressurized fluid to expand same by said pressurized fluid, said pressurized fluid comprising said expansion medium.

25. Method according to claim 23, wherein said bolt is expanded against the borehole over a large part of its length.

26. Method according to claim 23, wherein said bolt is expanded against the borehole over substantially its entire length.

27. A method of reinforcing rock comprising:

providing a bolt that comprises an expansible elongated tube which has a deep continuous longitudinal depression which extends inwardly of the bolt toward the axis of the bolt, the tube having a closed cross section including said depression and a major portion having a generally cylindrical outer surface, and being closed at one end thereof;

drilling a circular hole in the rock of a diameter large enough to permit the unexpanded bolt to be freely inserted in the borehole;

inserting the bolt in the borehole with said closed end first;

coupling the other end of said tube to an external source of hydraulic pressure fluid;

plastically deforming said tube by applying said hydraulic pressure fluid to the interior of said tube to expand said tube against the borehole over substantially the entire length of the bolt by expanding said depression outwardly substantially without stretching the material of the tube so as to cause permanent gripping action of said generally cylindrical outer surface against the inner surface of the borehole.

28. A method of reinforcing rock comprising:

plastically deforming a transverse cross-section of a circular tube so that its transverse size is reduced, at least a continuous portion of said tube in its longitudinal direction having said plastically deformed cross section to form a plastically deformed portion of the tube, said cross section being a closed cross section and said plastically deformed portion of the tube including a major portion having a generally cylindrical outer surface;

drilling a circular hole in the rock, the hole having a diameter larger than the reduced transverse size of the plastically deformed tube so that the deformed tube can be freely inserted into the borehole;

inserting the deformed tube in the borehole; and then further plastically deforming the deformed tube in the borehole substantially without stretching the material of the tube by applying an expansion medium to the interior of the tube so that it expands the deformed portion of the tube in the transverse direction of the tube and thereby clamps said generally cylindrical outer surface frictionally against the inner surface of the borehole.

29. The method of claim 28 wherein said borehole in said rock has a smaller diameter than the initial diameter of the circular tube.

30. Method according to claim 28, wherein in said first step, said tube is plastically deformed so that said tube, in cross-section, has a closed continuous peripheral length in a direction transverse to the axial direction of the tube that exceeds the circumference of the borehole, the bolt, in its initial plastically deformed state, having said reduced transverse size which is smaller than the diameter of the hole in the rock.

31. A method of rock bolting comprising:

providing a bolt that comprises a radially expansible elongated tube which, before being used, has a deep closed continuous longitudinal depression extending inwardly of the tube toward the axis of the tube, the tube being closed at one end thereof, the tube having a closed continuous cross-sectional portion at least over the longitudinally depressed portion thereof, the depression extending inwardly from a major portion of the tube having a generally cylindrical outer surface;

drilling a circular hole in the rock of a diameter that is larger than the largest transverse dimension of the bolt before being used but smaller than the largest transverse dimension of the bolt if said longitudinal depression is fully expanded, so that the longitudinal depression cannot be fully expanded when the bolt is in the borehole;

inserting the bolt in the borehole with said closed bottom end first;

coupling the other end of said tube to an external source of hydraulic high pressure fluid to fill the interior of the tube with the high pressure fluid under substantially static conditions so that the fluid is plastically deformed under the influence of said high pressure fluid to expand said depression outwardly of the tube so as to cause permanent gripping action of said generally cylindrical outer surface against the inside surface of the borehole over substantially the entire length of the tube.

32. Method according to claim 31, wherein said tube, before being used, is plastically deformed so that said tube, in cross-section, has a closed continuous peripheral length in a direction transversed to the axial direction of the tube that exceeds the circumference of the borehole, the tube, in its initial plastically deformed state, having a transverse size which is smaller than the diameter of the borehole in the rock.

* * * * *